US011970915B2

(12) United States Patent
Liess et al.

(10) Patent No.: US 11,970,915 B2
(45) Date of Patent: Apr. 30, 2024

(54) SPIDER LOAD INDICATOR

(71) Applicant: Weatherford Technology Holdings, LLC, Houston, TX (US)

(72) Inventors: Martin Liess, Seelze (DE); Georg Zimbelmann, Lehrte (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/858,941

(22) Filed: Jul. 6, 2022

(65) Prior Publication Data

US 2024/0011360 A1 Jan. 11, 2024

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 4,417,767 A * 11/1983 Billeter ..... B60T 8/1893 303/22.2
7,281,587 B2 10/2007 Haugen
8,215,687 B2 7/2012 Pietras et al.
8,230,933 B2 7/2012 Snider et al.
8,251,151 B2 8/2012 Haugen
8,356,675 B2 1/2013 Pietras et al.
8,439,121 B2 * 5/2013 Nikiforuk ..... E21B 19/10 166/380
9,404,322 B2 8/2016 Wiedecke et al.
9,500,047 B2 11/2016 Brown et al.
2003/0145984 A1 * 8/2003 Webre ..... E21B 19/07 166/66
2013/0118760 A1 5/2013 Kuttel et al.
2014/0041854 A1 * 2/2014 Robichaux ..... E21B 19/10 166/77.52
2015/0034335 A1 * 2/2015 Brown ..... E21B 19/10 166/77.51
2016/0273334 A1 9/2016 Smith

* cited by examiner

*Primary Examiner* — Cathleen R Hutchins
*Assistant Examiner* — Ronald R Runyan
(74) *Attorney, Agent, or Firm* — Smith IP Services, P.C.

(57) ABSTRACT

A tubular gripping assembly for handling a tubular includes a housing; a plurality of gripping members for gripping the tubular; a first fluid line for opening the gripping members, the first fluid line having a one-way valve; and second fluid line for closing the gripping members. The tubular gripping assembly also includes an indicator assembly attached to the housing. The indicator assembly has an indicator movable relative to the housing. The indicator assembly also includes a sensor valve configured to open the check valve for fluid communication through the first fluid line in response to relative axial movement between the indicator and the housing.

19 Claims, 9 Drawing Sheets

SPIDER LOAD INDICATOR

BACKGROUND

Field

Embodiments of the present disclosure generally relate to a load indicator for use with a tubular gripping apparatus, such as a spider.

Description of the Related Art

The handling and supporting of tubular pipe strings has traditionally been performed with the aid of wedge shaped members known as slips. In some instances, these members operate in a tubular gripping apparatus, such as an elevator or a spider. Typically, an elevator or a spider includes a plurality of slips circumferentially surrounding the exterior of the pipe string. The slips are disposed in a housing. The inner sides of the slips usually carry teeth formed on hard metal dies for engaging the pipe string. The exterior surface of the slips and the interior surface of the housing have opposing engaging surfaces which are inclined and downwardly converging. The inclined surfaces allow the slip to move vertically and radially relative to the housing. In effect, the inclined surfaces serve as wedging surfaces for engaging the slip with the pipe. Thus, when the weight of the pipe is transferred to the slips, the slips will move downward with respect to the housing. As the slips move downward along the inclined surfaces, the inclined surfaces urge the slips to move radially inward to engage the pipe. In this respect, this feature of the spider is referred to as "self tightening/wedging effect." Further, the slips are designed to prohibit release of the pipe string until the pipe load is supported and lifted by another device.

In the makeup or breakout of pipe strings, the spider is typically used for securing the pipe string in the wellbore at a rig floor. Additionally, an elevator suspended from a rig hook includes a separately operable set of slips and is used in tandem with the spider. The elevator may include a self-tightening feature similar to the one in the spider. In operation, the spider holds the tubular string at an axial position while the elevator positions a new pipe section above the pipe string for connection. It is common to install centralizers on the pipe string to help centralize once the pipe string is in the wellbore. After completing the connection, the elevator pulls up on and bears the weight of the string thereby releasing the pipe string from the slips of the spider there below. The elevator then lowers the pipe string into the wellbore. Before the pipe string is released from the elevator, the slips of the spider are allowed to engage the pipe string again to support the pipe string. After the weight of the pipe string is switched back to the spider, the elevator releases the pipe string and continues the makeup or break out process for the next joint.

In some instances, the elevator and the spider are controlled by different people. For example, the driller controls the elevator, and the casing crew controls the spider. To check for load transfer, the pipe string is lifted, and the crews looks to see if the spider moves up with the pipe string. If a gap occurs between the spider and the rig-floor, then it is an indication that the load has been transferred from the spider to the elevator. The spider can now be opened. However, errors may occur with visual confirmations.

There is a need, therefore, for a load transfer indicator for use with a spider.

SUMMARY OF THE DISCLOSURE

In some embodiments, the indicator assembly 100 includes an overload protection for the sensor valve 110. Referring to FIG. 8, in some instances, a tool or debris 9 may be interfere with indicator 130 from contacting the rig floor 20. When this occurs, the indicator 130 is allowed to move up relative to the spider 10 without damaging the sensor valve 110. As seen FIG. 8, the connector plate 139 has moved away from the first lever portion 161 and further compressed the spring. FIG. 8A is a top view of an indicator display of the indicator assembly of FIG. 8. It is contemplated the indicator 130 may move from 10 mm to 20 mm above the rig floor 20.

In some embodiments, a tubular gripping assembly for handling a tubular includes a housing; a plurality of gripping members for gripping the tubular; a first fluid line for opening the gripping members, the first fluid line having a one-way valve; and second fluid line for closing the gripping members. The tubular gripping assembly also includes an indicator assembly attached to the housing. The indicator assembly has an indicator movable relative to the housing. The indicator assembly also includes a sensor valve configured to open the check valve for fluid communication through the first fluid line in response to relative axial movement between the indicator and the housing.

In one embodiment, a method of operating a tubular gripping assembly including using slips of the tubular gripping assembly to grip a tubular and contacting an indicator with a rig floor, the indicator coupled to the tubular gripping assembly. The method also includes lifting the tubular gripping assembly relative to the indicator by lifting the tubular. A sensor valve is moved in response to lifting of the tubular gripping assembly, thereby allowing a check valve in an open line to move to an open position. Thereafter, a fluid is supplied through the check valve in the open line to open the slips.

In one embodiment, a method of connecting a first tubular to a second tubular includes using slips of the tubular gripping assembly to grip the first tubular and connecting the second tubular to the first tubular. The method also includes contacting an indicator with a rig floor, wherein the indicator coupled to the tubular gripping assembly. The method further includes lifting the tubular gripping assembly relative to the indicator by lifting the second tubular. A check valve in an open line is opened in response to lifting of the tubular gripping assembly. Thereafter, a fluid is supplied through the check valve in the open line to open the slips.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
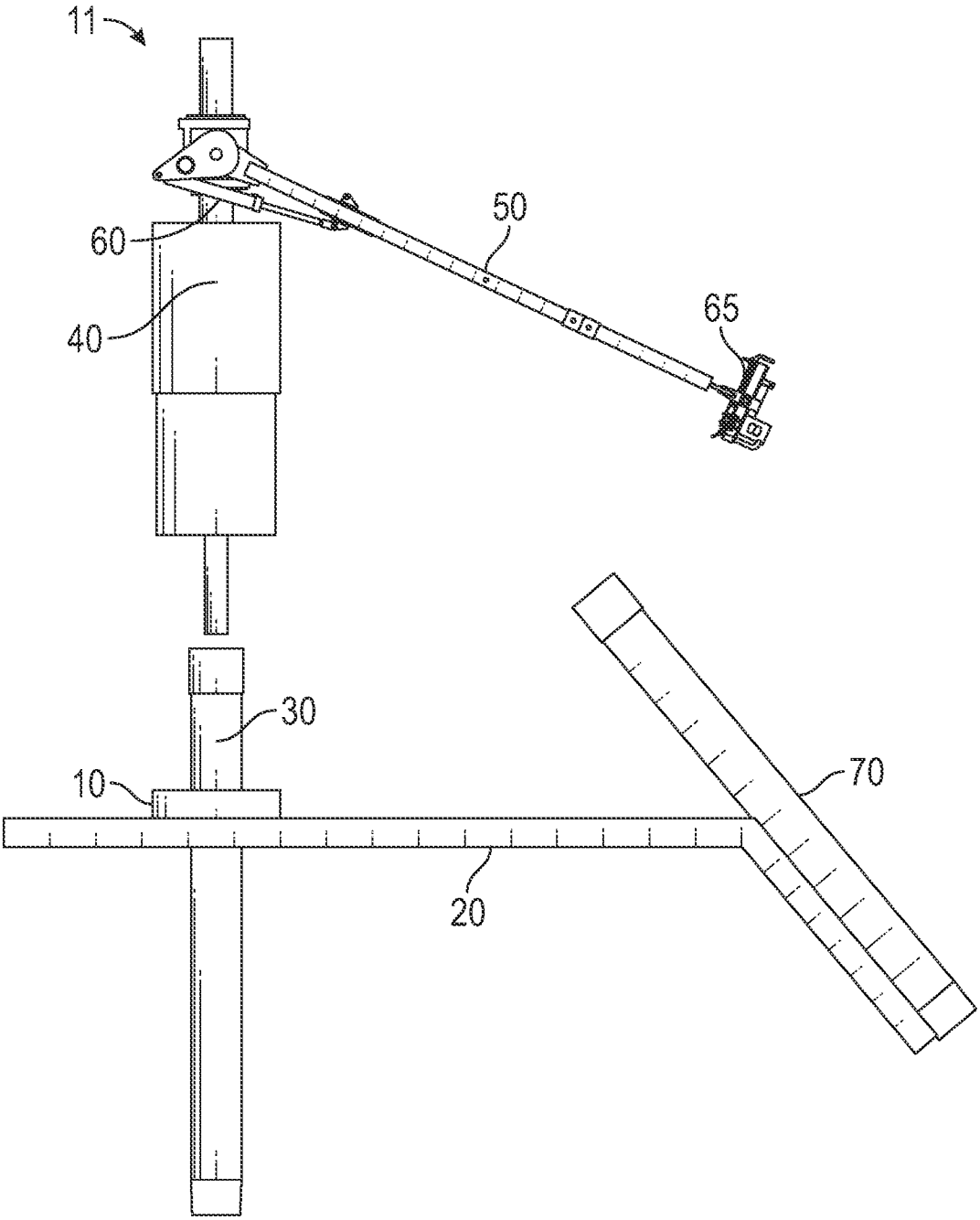
FIG. 1 illustrates an exemplary embodiment of a tubular handling system 11.

FIG. 1 illustrates an exemplary tubular handling system 11 configured to makeup or breakout a tubular string 30. As shown, the tubular string 30 is supported at a rig floor 20 using tubular gripping apparatus, such as a spider 10. A tubular handling unit 40 for handling the tubular string 30 is positioned above the tubular string 30. The tubular handling unit 40 may be attached to a top drive suspended from a rig (not shown). In this example, the tubular handling unit 40 is an internal gripping tool configured to grip the interior of the tubular string 30. In some embodiments, the tubular handling unit 40 may be an external gripping tool configured to grip the exterior of the tubular string 30. In some embodiments still, the tubular handling unit 40 may be configured to threadedly connect to the tubular string 30. The tubular handling unit can grip, rotate, and axially move the tubular string 30. In some embodiments, the tubular handling unit 40 can grip a tubular 70 to be added and rotate it for connection to the tubular string 30. A pair of handling bails 50 is pivotally attached to the tubular handling unit 40. The bails 50 may be raised or lowered using hydraulic cylinders 60. An elevator 65 is attached to an end of the bails 50. The tubular string 30 may be a drill string, casing string, a tubing string, or any suitable tubular string for insertion into a wellbore. In some embodiments, a tong assembly is used to connect the tubular 70 to the tubular string 30, and use of the tubular handling unit 40 is optional.

Figure 2:
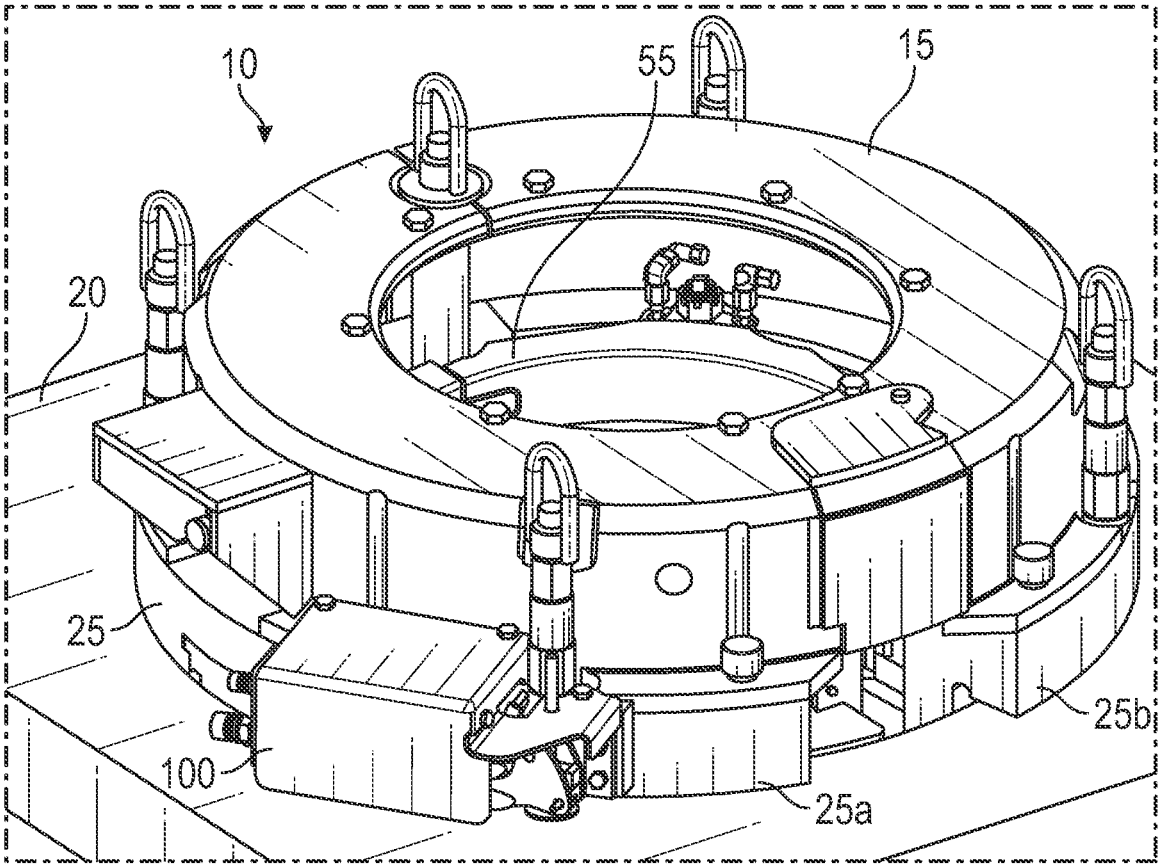
FIG. 2 is a perspective view of an exemplary load transfer indicator attached to a tubular gripping apparatus, according to embodiments of the present disclosure.

FIG. 2 is a perspective view of an exemplary tubular gripping apparatus equipped with a load transfer indicator assembly 100 suitable for use with the tubular handling system 11. As shown, the tubular gripping apparatus is a spider 10 that is disposed on the rig floor 20. The spider 10 includes a housing 25 for housing one or more gripping members, such as slips, and a cover assembly 15 on the housing 25. The housing 25 of the spider 10 is formed by pivotally coupling two sections 25*a,b* using one or more connectors, preferably hinges formed on both sides of each body section, to couple the two body sections together. The housing 25 includes a bore extending therethrough. A hole is formed through each hinge to accommodate a pin to couple the housing sections 25*a,b* together.

The spider 10 includes a leveling ring 55 for coupling the slips together and synchronizing their vertical movement. The leveling ring 55 may include two sections coupled together. Each ring section is coupled to one of the housing sections 25*a,b* such that the leveling ring 55 can open and close with the housing 25.

The cover assembly 15 includes two separate sections, each attached above a respective housing section 25*a,b*. The sectioned cover assembly 15 allows the housing sections 25*a,b* of the spider 10 to open and close without removing the cover assembly 15. The sections of the cover assembly 15 form a hole to accommodate the tubular string 30 and the centralizers.

Figure 3A:
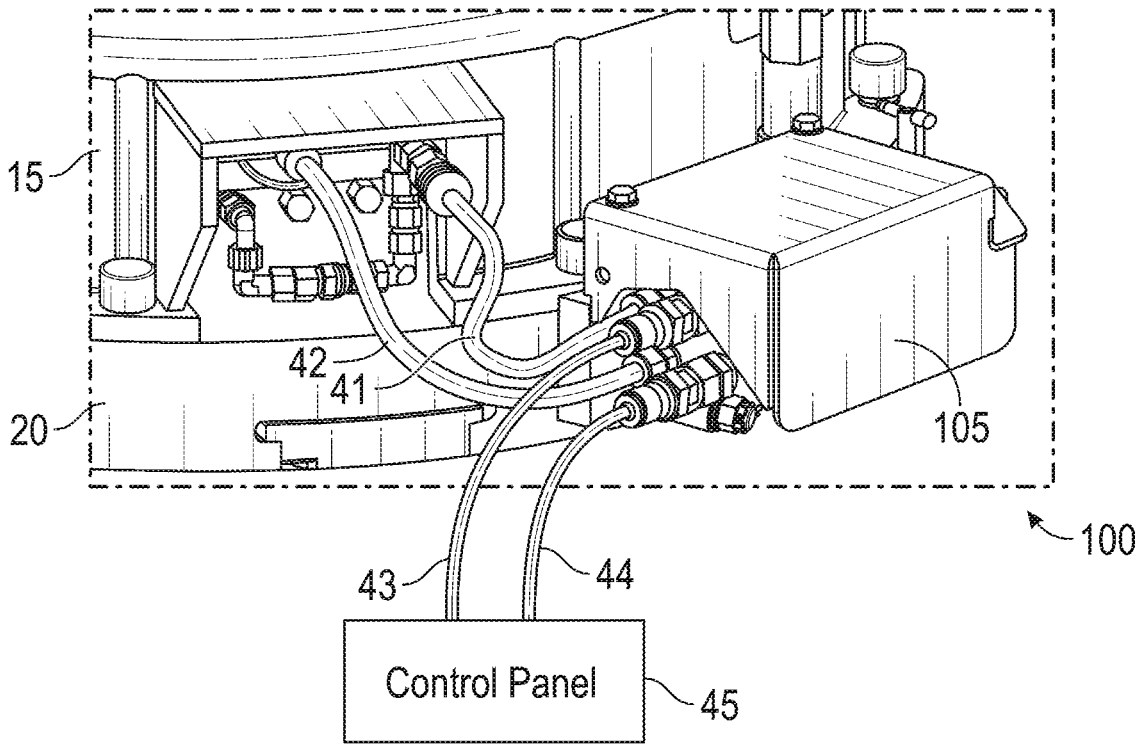
FIG. 3A is a different perspective view of the load transfer indicator attached to the housing of the tubular gripping apparatus.
Figure 3B:
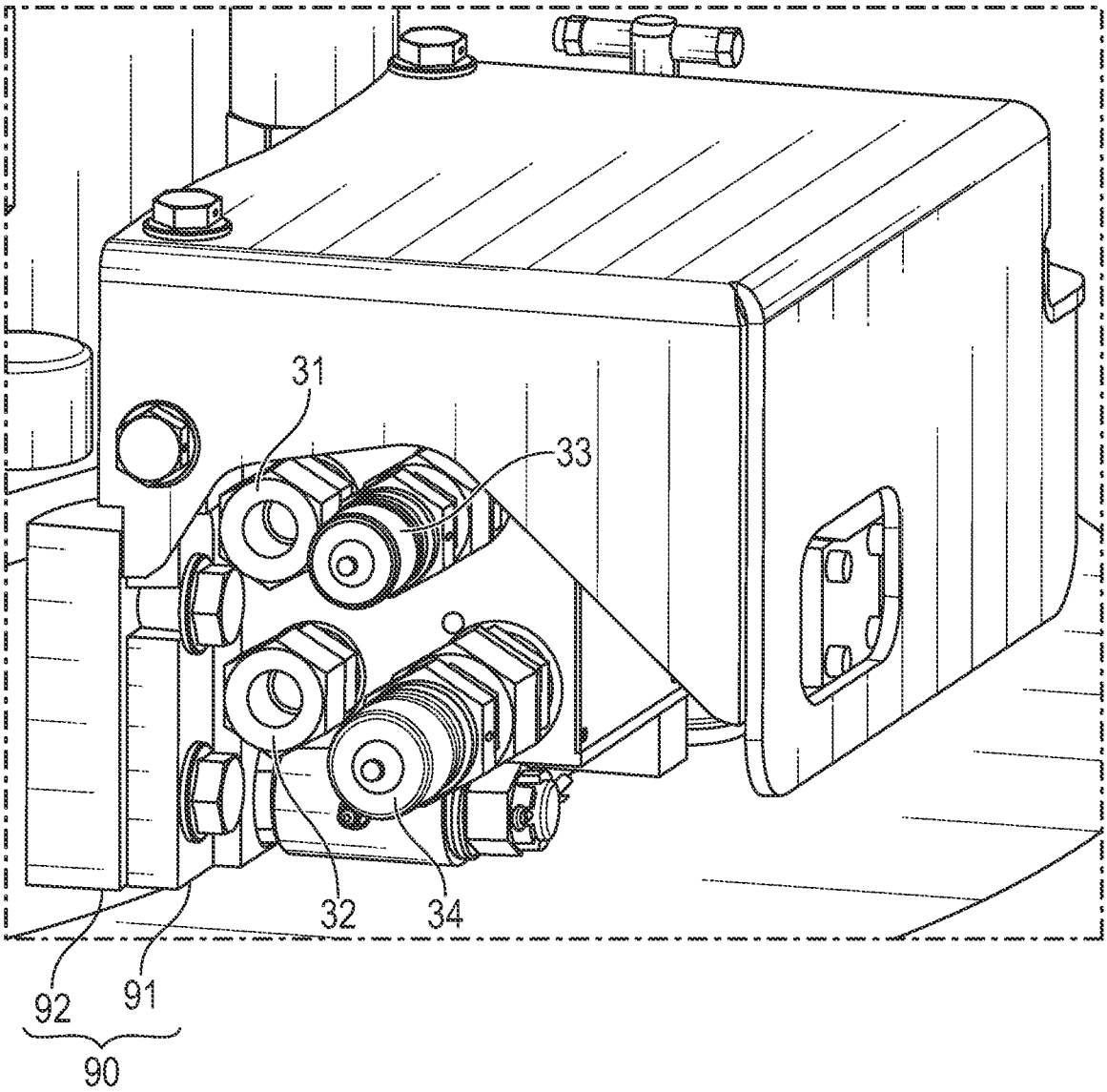
FIG. 3B is another perspective view of the indicator assembly of FIG. 2 attached to the tubular gripping apparatus.
Figure 4:
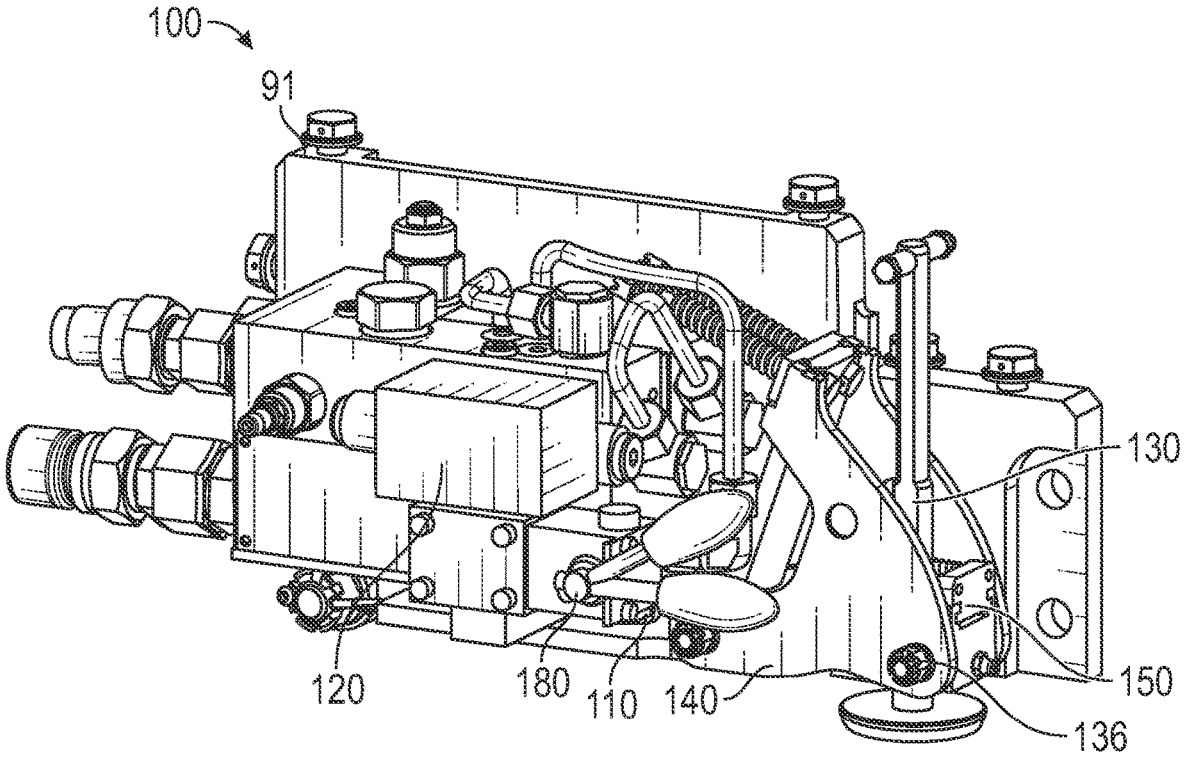
FIG. 4 shows the load transfer indicator assembly of FIG. 2 without its housing, according to some embodiments.

In some embodiments, the spider 10 includes a load transfer indicator assembly 100 attached to the housing 20, as shown in FIGS. 2, 3A, and 3B. FIG. 3A is a perspective view of the load transfer indicator assembly 100 attached to the housing 20. FIG. 3B is a perspective view of the indicator assembly 100 attached to the spider 10. FIG. 4 shows the indicator assembly 100 without its housing 105. In this embodiment, the indicator assembly 100 is attached to the spider housing 25 via its adapter plate 91. In some embodiments, an adapter assembly 90 is used to facilitate attachment of the adapter plate 91 to the housing 25. For example, the adapter assembly 90 can include one or more adapter supports 92, such as wedges, and screws, as shown in FIGS. 2 and 3B. It is contemplated the adapter assembly may have any suitable configuration to facilitate attaching the indicator assembly 100 to the spider 10. For example, the adapter assembly 90 may include one or more plates.

Referring to FIG. 4, the indicator assembly 100 includes a sensor valve 110, a memory valve 120, an activation system 140, and an override valve 180. Figure is a partial cross-sectional view of the indicator assembly 100. The sensor valve 110 is configured to open a check valve 212 (see FIG. 7) located in the open line from the control panel going toward the spider 10. In some embodiments, the check valve is a one-way valve. The memory valve 120 is configured to maintain the check valve 212 in the open position. The sensor valve 110 is actuatable by the activation system 140. In one embodiment, the activation system 140 includes an indicator 130 coupled to an indicator lock 150 and an activator arm assembly 135 coupled to the indicator lock 150. In some embodiments, the indicator 130 is an indicator rod. The indicator lock 150 includes a bore to accommodate axial movement of the indicator 130 and a lock plate 152 configured to limit axial movement of the indicator 130 relative to the indicator lock 150. The bore may be threadedly connected to the indicator 130. The lock plate 152 is biased away from the indicator 130. The indicator 130 is disposed in a slot of the lock plate 152. As shown, the indicator 130 is disposed in the lock end of the slot, wherein the lock end has a profile that complements the flat profile portion of the indicator 130. In this respect, the indicator 130 is not rotatable in the lock end of the slot. The slot is movable so the indicator 130 is located at the unlock end of the slot. The unlock end of the slot is sized to allow rotation of the indicator 130 such that the indicator 130 can move axially for adjustment of the indicator 130 relative to the spider 10. For example, the indicator 130 can be moved axially relative to the spider to adjust for the distance between the rig floor and the spider 10. In one embodiment, the slot at the lock end has a radius that is slightly larger than a radius of the indicator 130. The bottom of the indicator 130 may include a foot stand in the shape of a circle or any suitable shape. As shown in FIGS. 3A and 3B, the indicator assembly 100 includes first port 31 connected to the close line 41 of the spider 10 and a second port 32 connected to the open line 42 of the spider. The indicator assembly 100 also includes a third port 33 connected to the close line 43 of the control panel 45 and a fourth port 34 connected to the open line 44 of the control panel.

The activator arm assembly 135 is rotatably coupled to the indicator lock 150 using a connection device 136 such as a pin or a bolt. In one embodiment, the arm assembly 135 includes a first arm and a second arm that are disposed on each side of the indicator lock 150. The arms have a shape that is similar to a "V" shape in which the connection device 136 is connected to toward the bottom of the "V". Each arm has an upper extension 137 and a lower extension 138. However, it is contemplated the arms may have any suitable shape for supporting the upper and lower extensions 137 and 138, for example, a "C" shape or a trapezoid shape. The lower extension 138 is coupled to a valve lever assembly 160 having a first lever portion 161 and a second lever portion 162. The first lever portion 161 and the second lever portion are connected together, such as via welding. The first lever portion 161 is rotatable relative to the lower extension 138. The distal end of the first lever portion 161 is coupled to the upper extension 137. The distal end of the second lever portion 162 is coupled to the proximal end of the first lever portion 161. As shown, the second lever portion 162 is positioned horizontally with its distal end coupled to the first lever portion 161. The proximal end of the second lever portion 162 is coupled to the spider 10, thereby allowing the proximal end to move axially with the spider 10, such as when the spider is lifted. The second lever portion 162 is in contact with the bottom of a lever stop 167 and is in contact with the bottom of the roller 112 of the sensor valve 110. As shown, the roller 112 is in a depressed position in which the spider 10 cannot be opened.

The arm assembly 135 includes a connector plate 139 connected to the upper extension 137 of the first and second arms. The distal end of the first lever portion 161 can move into contact with the connector plate 139. The first lever portion 161 is coupled to the connector plate 139 of the arm assembly 135 using one or more coupling devices 170 such as a bolt. The coupling device 170 extends through the first lever portion 161 and the connector plate 139 and has a first end attached to the first lever portion 161. A biasing member such as a spring is disposed between a second end of the coupling device 170 and the connector plate 139.

Figure 5:
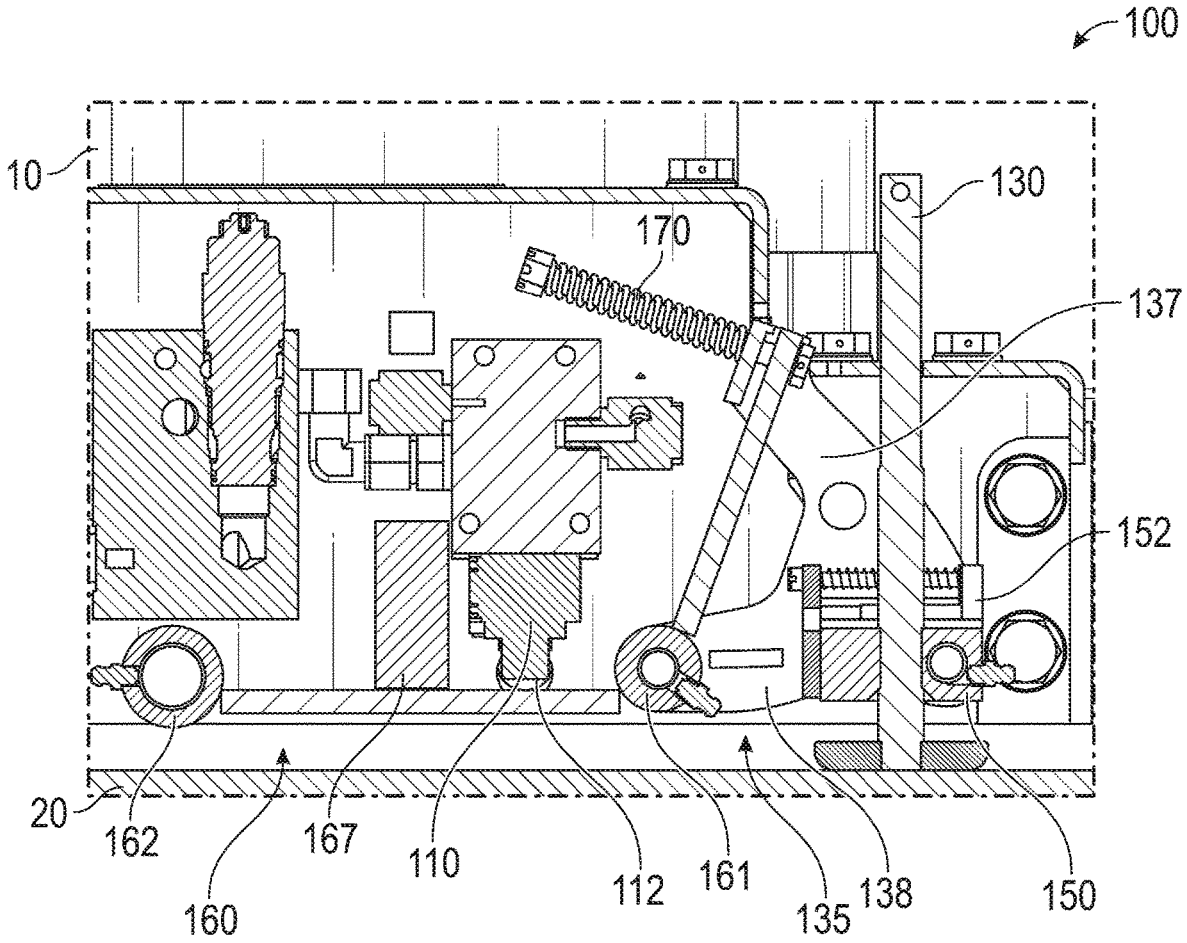
FIG. 5 is a partial cross-sectional view of the indicator assembly of FIG. 2 and the tubular gripping apparatus on a rig floor.
Figure 5A:
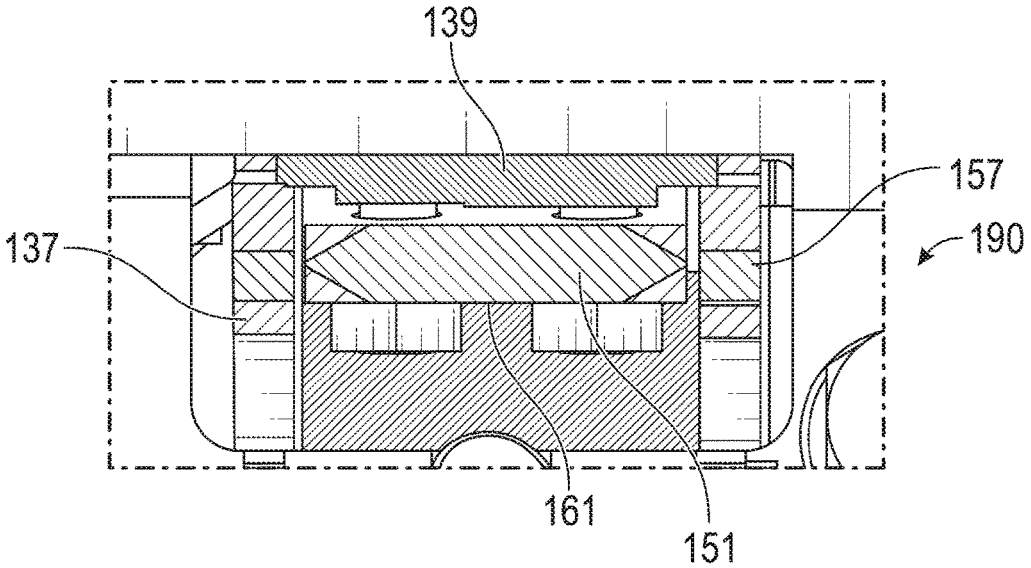
FIG. 5A is a top view of an indicator display of the indicator assembly of FIG. 5.

As illustrated in FIG. 5A, the indicator assembly 100 includes an indicator display 190. As shown, the top of the first lever portion 161 includes an indicator arrow 151, and the upper extensions 137 of the first and second arms of the arm assembly 135 include a spider "ready" region 157. It can be seen that the indicator arrow 151 is positioned in the ready region 157, thereby indicating the sensor valve 110 is depressed and the spider 10 ready to open if the spider is lifted upward a predetermined distance, such as from 2 mm to 15 mm, or from 3 mm to 5 mm. Also, a gap exists between the first lever portion 161 and the connector plate 139.

In operation, the tubular handling system 11 shown in FIG. 1 can be used to make up or break out a tubular string 30. For example, to make up a tubular, the elevator 65 is used to retrieve the tubular 70 to be added to the tubular string 30. The elevator 65 retains the tubular 70, and the elevator is raised to lift the tubular 70 above the tubular string 30. Also, the bails 50 are pivoted to move the tubular 70 into alignment with the tubular string 30 retained by the spider 10. Thereafter, the elevator is lowered to stab the tubular 70 into the tubular string 30. Then, the tubular handling unit 40 grips the tubular 70 and rotates the tubular 70 for connection with the tubular string 30. After connecting the tubular 70, the spider 10 is opened, and the tubular handling unit 40 lowers the extended tubular string 30 into the wellbore.

Figure 6:
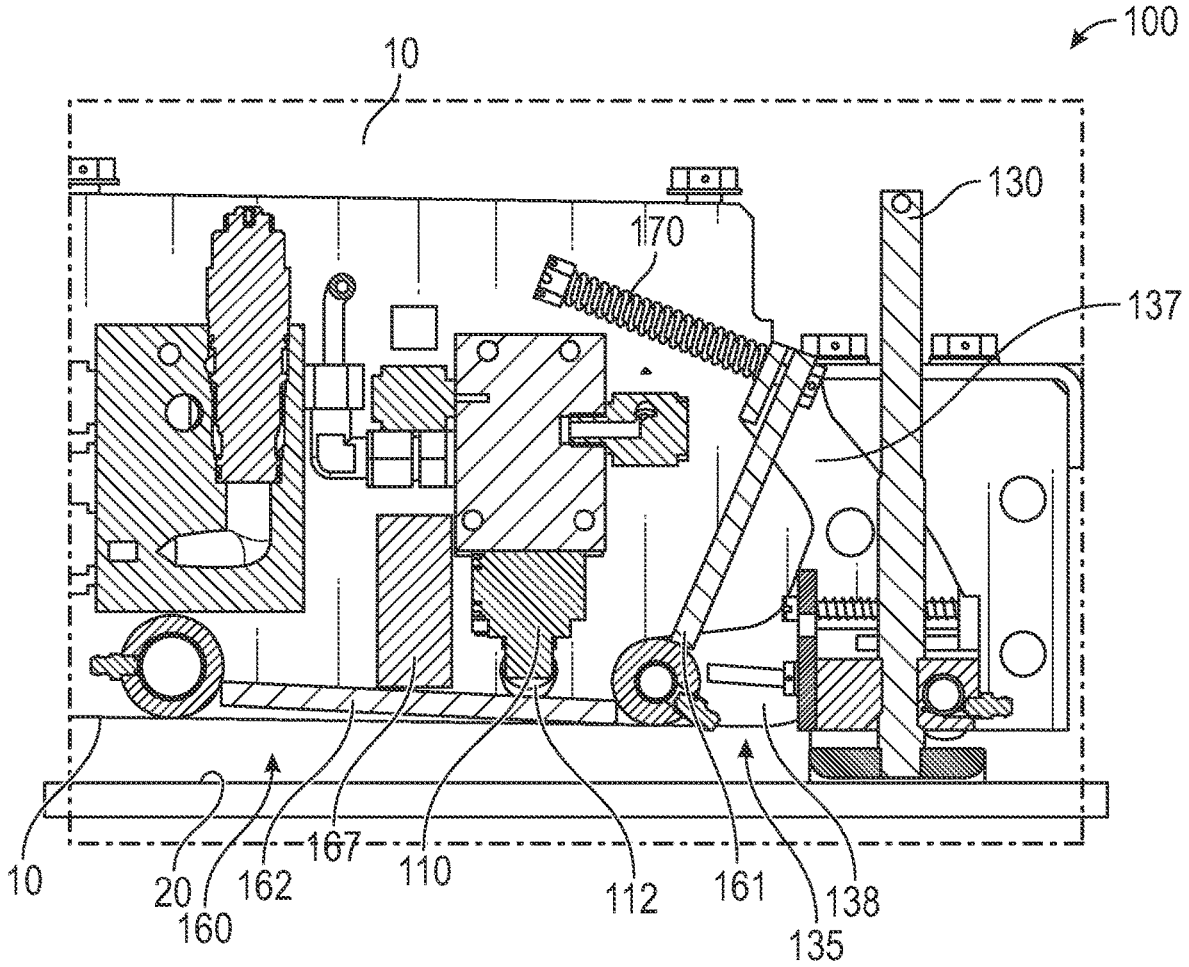
FIG. 6 is a partial cross-sectional view of the indicator assembly of FIG. 2 and the tubular gripping apparatus. The tubular gripping apparatus has been lifted up from the rig floor.
Figure 6A:
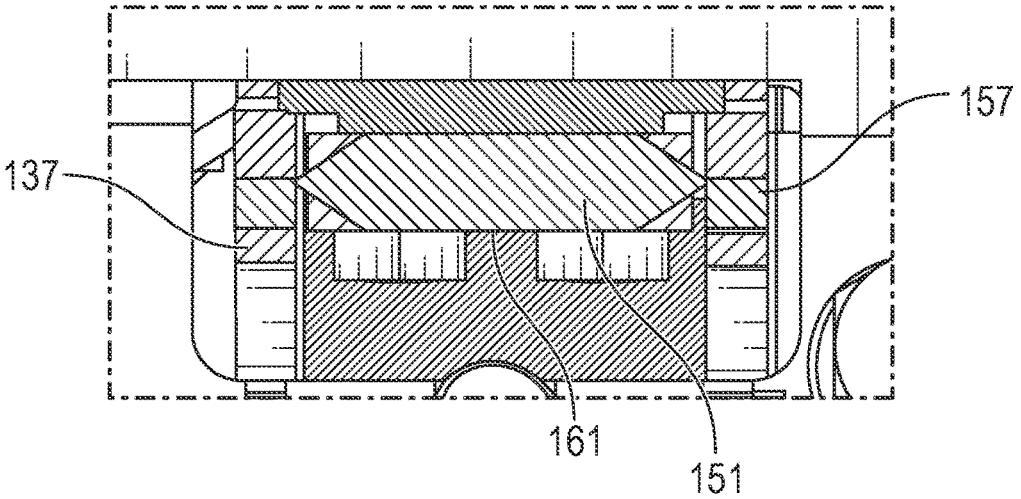
FIG. 6A is a top view of an indicator display of the indicator assembly of FIG. 6.

In some embodiments, prior to opening the spider 10, the indicator assembly 100 is used to indicate the load from the tubular string 30 has been transferred to the tubular handling unit 40. FIG. 5 shows the spider 10 sitting on the rig floor 20. In one example, the indicator assembly 100 can be actuated by lifting the spider 10. After connecting the tubular 70, the tubular string 30 gripped by the spider 10 is lifted. If the tubular handling unit 40 is carrying the weight of the tubular string 30, then the spider will be lifted up from the rig floor 20. When the spider 10 is lifted, the indicator 130 remains in contact with the rig floor 20. In effect, the spider 10 moves relative to the indicator 130. As seen in FIG. 6, the arm assembly 135 is rotated clockwise and lowered relative to the spider 10 in response to the lifting of the spider 10. Initially, the arm assembly 135 is rotated relative to the first lever portion 161 until the connector plate 139 contacts the first lever portion 161. As seen FIG. 6A, the indicator arrow 151 of the first lever portion 161 is outside of the ready region 157 of the upper extension 137. Then, the valve lever 160 will rotate about its proximal end as the proximal end is lifted along with the spider 10. In turn, the arm assembly 135 will move downward relative to the spider 10. FIG. 6 shows a gap between the bottom of the spider 10 and the rig floor 20 after the spider 10 has been lifted upward. FIG. 6 also shows the lower extension 138 closer to the bottom of the spider 10 than its position in FIG. 5. Rotation of the second lever portion 162 moves the second lever portion 162 away from the sensor valve 110. As a result, the roller 112 of the sensor valve 110 is allowed to extend downward, thereby allowing the check valve 212 in the open line from the panel to open.

Figure 7:
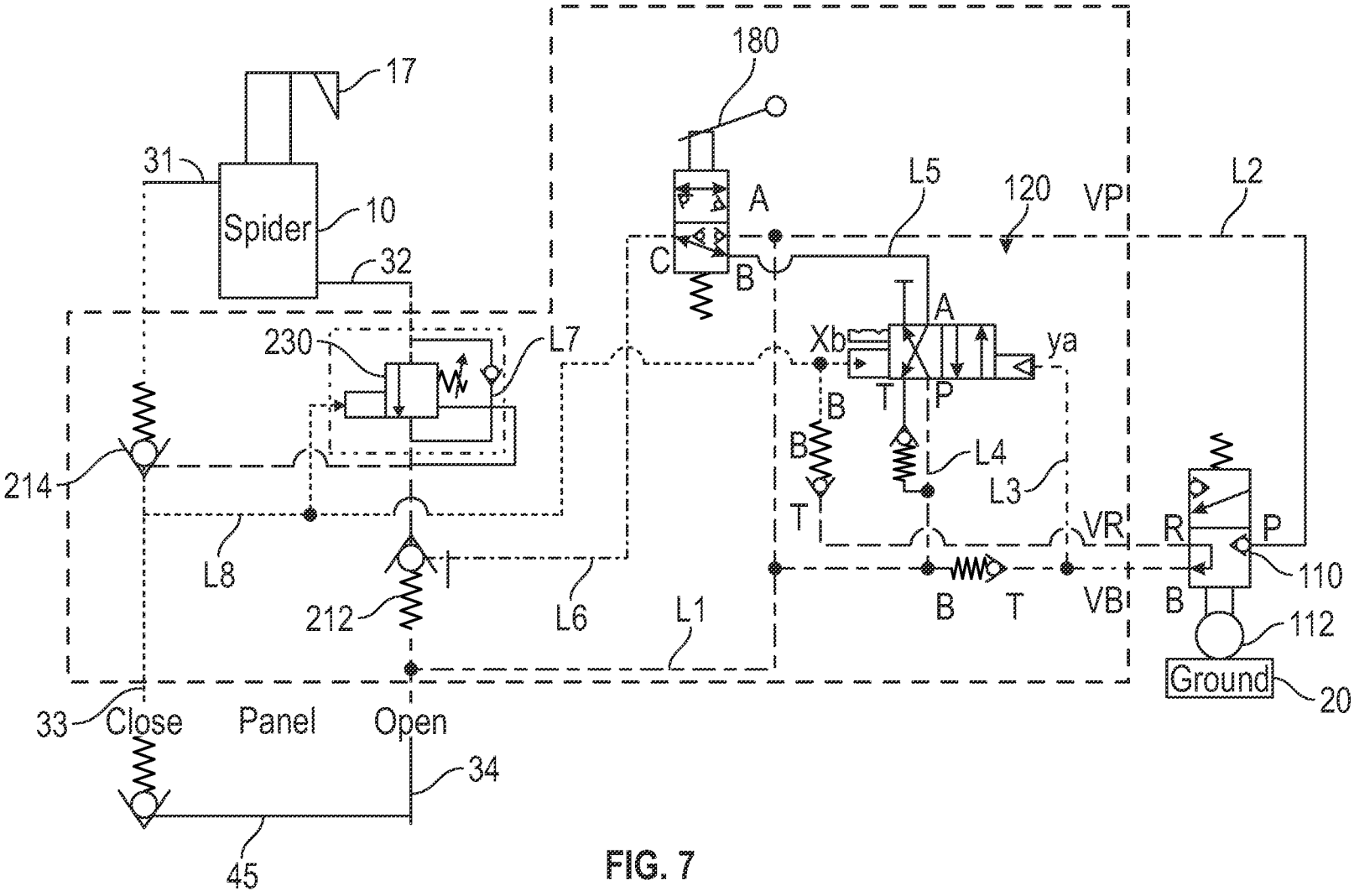
FIG. 7 is a schematic view of an exemplary embodiment of a hydraulic circuit for operating the tubular gripping apparatus and indicator assembly of FIG. 2.

FIG. 7 is a schematic view of an exemplary embodiment of a hydraulic circuit for operating the spider 10. In some embodiments, when the roller 112 of the sensor valve 110 moves downward, line L2 is placed in fluid communication with line L3. Thus, fluid in the open line 34 can flow through line L1, through line L2, and through line L3. Fluid in line 3 causes the memory valve 120 to shift to the left position, thereby placing line L4 in fluid communication with line L5, which is in fluid communication with line L5. As a result, fluid in open line 34 can flow from line L1 to line L6 to open the check valve 212. In this embodiment, the memory valve 120 remains in the left position even though the spider 10 is lowered back onto the rig floor 20. In this embodiment, the memory valve 120 does not return until the spider 10 is closing. After the check valve opens 212, fluid in the open 34 can flow through line L7 and through the open line 32 of the spider 10, thereby causing the slips 17 of the spider 10 to open. In some embodiments, an optional reverse valve 230 is used to allow selective reverse flow of the fluid in the open line 32 of the spider 10.

To close the spider 10 to grip the tubular string 30, fluid is flowed through the close line 33 from the control panel 45. Fluid in the close line 33 flows through line L8 to shift the reverse valve 230 to the right, thereby placing the open line 32 in fluid communication with the open line 34. Fluid in line L8 also causes the memory valve 120 to shift back to the right position, thereby closing fluid communication between line L5 and line L4. Because the spider 10 is sitting on the rig floor 20, the sensor valve 110 is depressed, which closes fluid communication between line L2 and line L3. Fluid in the close line 33 flow through the check valve 214, through the close line 31, and into the spider 10, thereby causing the slips 17 to close around the tubular string 30. As the slips 17 close, fluid in the spider 10 can flow out through the open line 32 and through the open line 34 of the control panel 45.

In some embodiments, a tong assembly is used to makeup the tubular 70 to the tubular string 30 instead of using the tubular handling unit 40. For example, after the tubular 70 is stabbed into the tubular string 30, the tubulars 70, 30 are made up using the tong assembly. The tong assembly includes a wrenching tong for gripping the tubular 70 and a backup tong for gripping the tubular string 30. After connecting the tubulars 70, 30, the spider 10 is opened, and the elevator 65 lowers the extended tubular string 30 into the wellbore. In this embodiment, the elevator 65 is used to lift the tubular string 30 to actuate the indicator assembly 100. If the weight has been transferred to the elevator 65, the indicator assembly 100 will allow the spider 10 to be opened when the spider 10 is lifted.

In some embodiments, the activation system 140 includes an optional override valve 180. In the event one of the valves of the activation system 140 malfunctions, such as a valve sticking, the override valve 180 can be activated to allow fluid in open line 34 to open the check valve 212. As shown in FIG. 7, during typical operation, the override valve 180 allows fluid communication between line L5 and line L6. The override valve 180 can be activated by pressing the valve 180. In turn, line L1 is placed in fluid communication with line L6. As a result, fluid in open line 34 can flow into line L6 to open the check valve 212.

Figure 8:
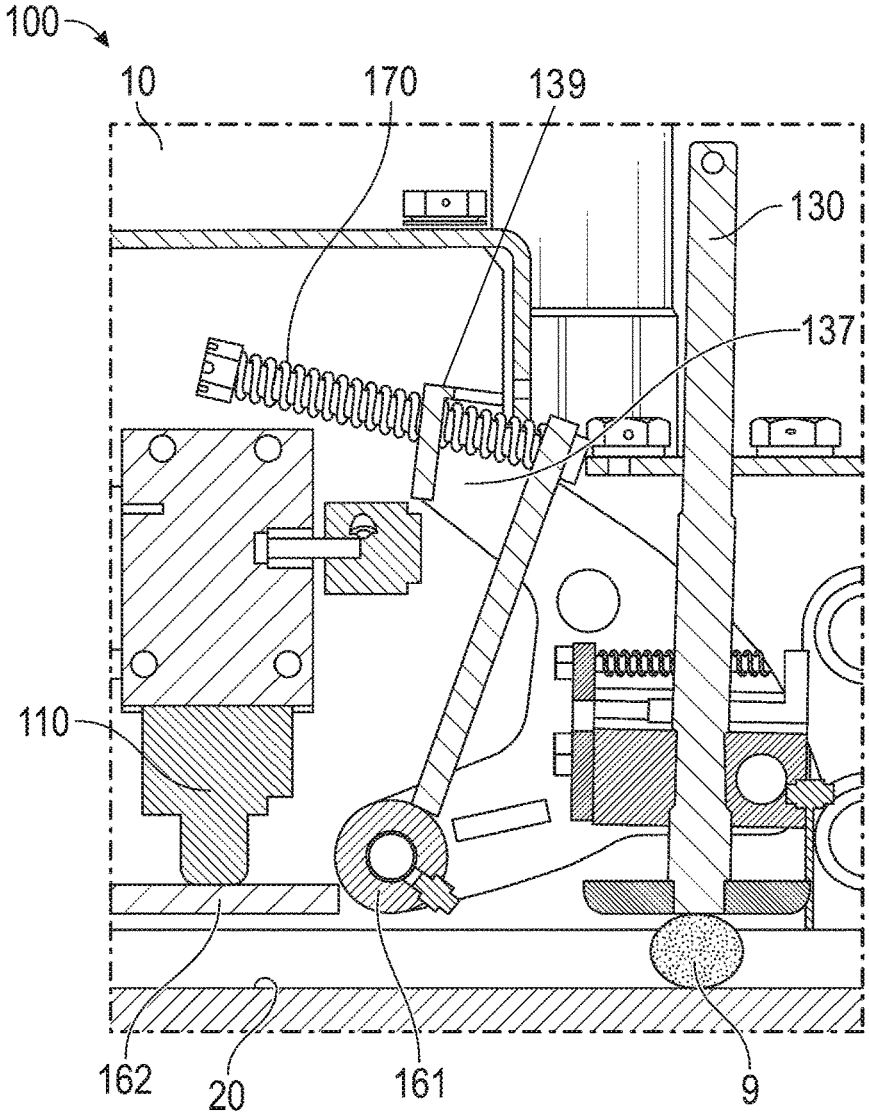
FIG. 8 is a partial cross-sectional view of the indicator assembly of FIG. 2 in a different position of operation.
Figure 8A:
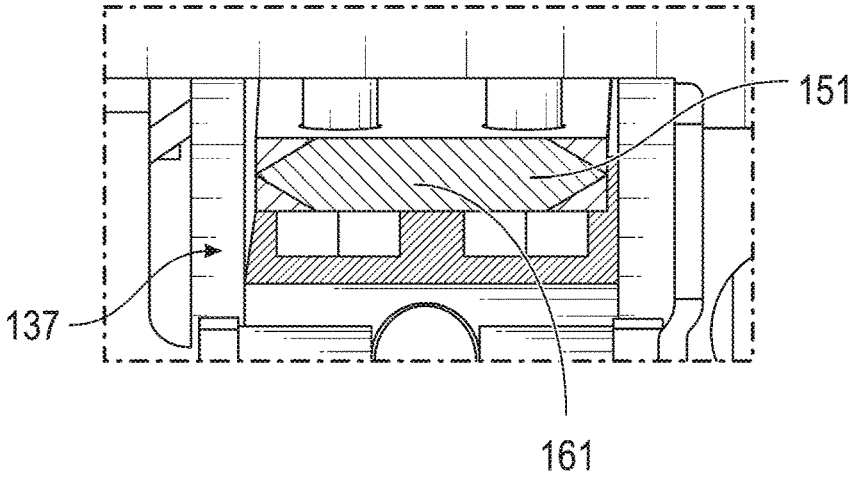
FIG. 8A is a top view of an indicator display of the indicator assembly of FIG. 8.

In some embodiments, the indicator assembly 100 includes an overload protection for the sensor valve 110. Referring to FIG. 8, in some instances, a tool or debris 9 may be interfere with indicator 130 from contacting the rig floor 20. When this occurs, the indicator 130 is allowed to move up relative to the spider 10 without damaging the sensor valve 110. As seen FIG. 8, the connector plate 139 has moved away from the first lever portion 161 and further compressed the spring. FIG. 8A is a top view of an indicator display of the indicator assembly of FIG. 8. It is contemplated the indicator 130 may move from 10 mm to 20 mm above the rig floor 20.

In some embodiments, a tubular gripping assembly for handling a tubular includes a housing; a plurality of gripping members for gripping the tubular; a first fluid line for opening the gripping members, the first fluid line having a one-way valve; and second fluid line for closing the gripping members. The tubular gripping assembly also includes an indicator assembly attached to the housing. The indicator assembly has an indicator movable relative to the housing. The indicator assembly also includes a sensor valve configured to open the check valve for fluid communication through the first fluid line in response to relative axial movement between the indicator and the housing.

In one or more embodiments described herein, the assembly includes a memory valve configured to maintain the check valve open for fluid communication.

In one or more embodiments described herein, the assembly includes an indicator lock configured to lock the indicator in a fixed position.

In one or more embodiments described herein, the indicator assembly includes an activator arm pivotally coupled to the indicator.

In one or more embodiments described herein, the indicator assembly includes a valve lever coupled to the activator arm, the valve lever having a first lever portion and a second lever portion.

In one or more embodiments described herein, the indicator assembly includes a coupling device for coupling the first lever portion to the activator arm.

In one or more embodiments described herein, the coupling device extends through the first lever portion and a connector plate of the activator arm.

In one or more embodiments described herein, the first lever portion is movable into contact with the connector plate.

In one or more embodiments described herein, the indicator assembly includes an indicator display having an indicator arrow disposed on the first lever portion and a closed region on the activator arm.

In one or more embodiments described herein, the sensor valve is configured to engage the second lever portion.

In one or more embodiments described herein, one end of the valve lever is movable with the housing.

In one or more embodiments described herein, the second fluid line includes a second check valve.

In one or more embodiments described herein, the indicator assembly includes an override valve configured to open the check valve.

In one embodiment, a method of operating a tubular gripping assembly including using slips of the tubular gripping assembly to grip a tubular and contacting an indicator with a rig floor, the indicator coupled to the tubular gripping assembly. The method also includes lifting the tubular gripping assembly relative to the indicator by lifting the tubular. A sensor valve is moved in response to lifting of the tubular gripping assembly, thereby allowing a check valve in an open line to move to an open position. Thereafter, a fluid is supplied through the check valve in the open line to open the slips.

In one embodiment, a method of connecting a first tubular to a second tubular includes using slips of the tubular gripping assembly to grip the first tubular and connecting the second tubular to the first tubular. The method also includes contacting an indicator with a rig floor, wherein the indicator coupled to the tubular gripping assembly. The method further includes lifting the tubular gripping assembly relative to the indicator by lifting the second tubular. A check valve in an open line is opened in response to lifting of the tubular gripping assembly. Thereafter, a fluid is supplied through the check valve in the open line to open the slips.

In one or more embodiments described herein, the method includes activating a memory valve after moving the sensor valve.

In one or more embodiments described herein, the memory valve maintains the check valve in the open position.

In one or more embodiments described herein, the fluid flows through the sensor valve to activate the memory valve.

In one or more embodiments described herein, the method includes using a reverse valve to prevent reverse flow of fluid in the open line.

In one or more embodiments described herein, lifting the tubular gripping assembly causes an activator arm to rotate relative to the indicator.

In one or more embodiments described herein, rotation of the activator arm moves a lever portion away from the sensor valve.

In another embodiment, a tubular handling system for handling a tubular includes a tubular gripping apparatus having a plurality of gripping members for gripping the tubular and a tubular lifting apparatus configured to configured to axially move the tubular. A first fluid line is used to open the gripping members, and a second fluid line is used to close the gripping members. The first fluid line has a one-way valve for controlling flow through the first fluid line. The tubular handling system also includes an indicator assembly attached to the housing. The indicator assembly has an indicator movable relative to the tubular gripping apparatus and a sensor valve configured to open the one way valve for fluid communication through the first fluid line in response to relative axial movement between the indicator and the tubular gripping apparatus.

In one or more embodiments described herein, the tubular handling system includes a memory valve configured to maintain the one way valve open for fluid communication.

In one or more embodiments described herein, the tubular lifting apparatus is a tubular handling unit configured to grip and rotate the tubular.

In one or more embodiments described herein, the tubular lifting apparatus is an elevator.

While the foregoing is directed to embodiments of the present disclosure, other and further embodiments of the disclosure may be devised without departing from the basic scope thereof, and the scope thereof is determined by the claims that follow.

The invention claimed is:

1. A tubular gripping assembly for handling a tubular, comprising:

a housing disposed on a rig floor, in which the housing contains a plurality of gripping members for gripping the tubular;

a first fluid line for opening the gripping members, the first fluid line having a first check valve;

a second fluid line for closing the gripping members; and a load transfer indicator assembly attached to the housing, the load transfer indicator assembly having:

an indicator configured to contact the rig floor prior to a transfer of a weight of the tubular away from the tubular gripping assembly, in which the indicator is movable relative to the housing; and a sensor valve configured to open the first check valve for fluid communication through the first fluid line in response to relative axial movement between the indicator and the housing.

2. The assembly of claim 1, further comprising a memory valve configured to maintain the first check valve open for fluid communication.

3. The assembly of claim 1, further comprising an indicator lock configured to permit axial adjustment of the indicator within the indicator assembly.

4. The assembly of claim 1, further comprising an activator arm pivotally coupled to the indicator.

5. The assembly of claim 4, further comprising a valve lever coupled to the activator arm, the valve lever having a first lever portion and a second lever portion.

6. The assembly of claim 5, further comprising a coupling device for coupling the first lever portion to the activator arm.

7. The assembly of claim 6, wherein the coupling device extends through the first lever portion and a connector plate of the activator arm.

8. The assembly of claim 7, wherein the first lever portion is movable into contact with the connector plate.

9. The assembly of claim 8, further comprising an indicator display having an indicator arrow disposed on the first lever portion and a closed region on the activator arm.

10. The assembly of claim 5, wherein the sensor valve is configured to engage the second lever portion.

11. The assembly of claim 5, wherein one end of the valve lever is movable with the housing.

12. The assembly of claim 1, wherein the second fluid line includes a second check valve.

13. The assembly of claim 1, further comprising an override valve configured to open the first check valve.

14. A method of operating a tubular gripping assembly, comprising:

using slips of the tubular gripping assembly to grip a tubular;

directly contacting an indicator with a rig floor, the indicator coupled to the tubular gripping assembly;

lifting the tubular gripping assembly relative to the indicator by lifting the tubular;

moving a sensor valve in response to lifting of the tubular gripping assembly, thereby allowing a check valve in an open line to move to an open position; and supplying a fluid through the check valve in the open line to open the slips.

15. The method of claim 14, further comprising activating a memory valve after moving the sensor valve.

16. The method of claim 15, wherein the memory valve maintains the check valve in the open position.

17. The method of claim 15, wherein the fluid flows through the sensor valve to activate the memory valve.

18. The method of claim 15, further comprising using a reverse valve to prevent reverse flow of fluid in the open line.

19. A tubular handling system for handling a tubular, comprising:

a tubular gripping apparatus having a plurality of gripping members for gripping the tubular;

a tubular lifting apparatus configured to axially move the tubular;

a first fluid line for opening the gripping members, the first fluid line having a one-way valve;

a second fluid line for closing the gripping members;

an indicator assembly attached to the housing, the indicator assembly having:

an indicator movable relative to the tubular gripping apparatus; and a sensor valve configured to open the one-way valve for fluid communication through the first fluid line in response to relative axial movement between the indicator and the tubular gripping apparatus; and a memory valve configured to maintain the one-way valve open for fluid communication.

* * * * *